US006317908B1

(12) United States Patent
Walpin

(10) Patent No.: US 6,317,908 B1
(45) **Date of Patent: *Nov. 20, 2001**

(54) SUPPORT DEVICE WITH VARIABLE FIRMNESS

(76) Inventor: Lionel A. Walpin, 127 W. Hazel St., Inglewood, CA (US) 90302

( * ) Notice: Subject to any disclaimer, the term of this patent is extended or adjusted under 35 U.S.C. 154(b) by 0 days.

This patent is subject to a terminal disclaimer.

(21) Appl. No.: 09/606,843

(22) Filed: Jun. 28, 2000

Related U.S. Application Data

(63) Continuation-in-part of application No. 09/496,834, filed on Feb. 2, 2000, now Pat. No. 6,182,312.

(51) Int. Cl.[7] ..... A47G 9/10
(52) U.S. Cl. ..... 5/636; 5/640; 5/644; 5/645
(58) Field of Search ..... 5/636, 639, 640, 5/643, 644, 645

(56) References Cited

U.S. PATENT DOCUMENTS

| | | | | |
|---|---|---|---|---|
| 3,243,828 | * | 4/1966 | McCarty | 5/636 |
| 3,411,164 | * | 11/1968 | Sumergrade | 5/644 |
| 3,924,283 | * | 12/1975 | Shave | 5/636 |
| 4,501,034 | * | 2/1985 | Greenawalt | 5/644 |
| 4,829,614 | * | 5/1989 | Harper | 5/644 |
| 4,916,765 | * | 4/1990 | Catronovo, Jr. | 5/636 |
| 4,918,774 | * | 4/1990 | Popitz | 5/644 |
| 5,638,564 | * | 6/1997 | Greenawalt et al. | 5/636 |
| 6,182,312 | * | 2/2001 | Walpin | 5/636 |

* cited by examiner

*Primary Examiner*—Michael F. Trettel
(74) *Attorney, Agent, or Firm*—Lyon & Lyon LLP

(57) ABSTRACT

An orthopedic support device comprising an embodiment of the support device comprises a firm core, a recess located on a top surface of the core, a memory foam layer located within the recess, a cushion layer located along a top surface of the memory foam layer, a C-shaped boundary layer wrapped around a first lengthwise edge of the core, a bottom surface of the core, and a second lengthwise edge of the core, and one or more inflatable bladders disposed within the firm core.

17 Claims, 3 Drawing Sheets

SUPPORT DEVICE WITH VARIABLE FIRMNESS

RELATED APPLICATION DATA

This application is a continuation in part of U.S. patent application Ser. No. 09/496,834 filed on Feb. 2, 2000, now U.S. Pat. No. 6,182,312, which is incorporated by reference herein in its entirety.

FIELD OF THE INVENTION

The invention pertains to the field of orthopedic devices, including, support devices for the head and neck.

BACKGROUND OF THE INVENTION

Orthopedic head and neck support devices are designed to provide users with support and alignment of their head and neck region. A multitude of different orthopedic head and neck support device designs exist, and many of these devices use resilient foam materials to provide the necessary support. Flexible polyurethane foams are commonly used in the manufacture of these support devices, as are viscoelastic memory foams.

Unlike polyurethane foams, viscoelastic memory foams are designed to adapt more to the shape or form of a user's head as the user utilizes the device. When a user places their head on viscoelastic memory foam, the foam compresses and conforms to the shape of the user's head. This function of adapting to the shape of the user's head aids in providing a more comfortable support experience for the user. In addition, when the user then removes their head off of the viscoelastic memory foam, the foam returns to the shape it had prior to the compression, thus it is termed memory foam.

One drawback to the use of viscoelastic memory foams in orthopedic head and neck support devices is that when used alone, these foams tend to not offer enough support for the user. Some users consider them too soft for adequate support of the head and neck. So viscoelastic memory foams provide almost instant comfort, but they may be too soft for users and tend to lose their viscoelastic memory properties over time. When this happens, they compress and flatten and remain that way.

Unlike viscoelastic memory foams, polyurethane foams have different compression characteristics that require them to be broken in before the devices can achieve their greatest level of comfort. "Breaking in" a polyurethane foam simply refers to the process of repeatedly compressing the foam of a support device during its initial usage. The compression is caused by the weight of a user's head on the foam when in use. This repeated compression of the foam every time the user is using the device compresses the internal structure of the foam and pushes air out from within the structure. The polymers of the foam tend to "remember" this compressed structure, which makes the polymers tend to bias towards the compressed structure. Through this breaking-in process, the foam becomes softer and more pliable in the area of the compressed structure. And because the area of the compressed structure corresponds to the area where the user's head is pushing down on the foam, the foam is thus "conforming" to the shape of the user's head.

The break-in period for polyurethane foam can last from as little as a few hours to more often as long as several days to a week or more before the foam adequately softens and comfortably retains the shape of a user's head. This long of a break-in period may be unacceptable to potential users who require the head and neck support these devices offer, but are unable to endure the stiffness of a non-broken-in foam due to their medical conditions. For instance, users that have chronic (rheumatoid arthritis) or acute neck disorders (acute inflammation), or that have suffered a recent head trauma or neck injury with muscle spasm, typically cannot withstand any length of a break-in period.

Another drawback of polyurethane foam head and neck support devices is that they provide a single, fixed amount of firmness at any given point in time. This is disadvantageous to potential users because people tend to have any of a wide variety of medical conditions that generally require different amounts of support and firmness. Unfortunately, the foam used in known support devices cannot be adjusted to provide varying degrees of support based on the user's needs.

Accordingly, there is a need for an orthopedic support device that provides comfortable head and neck support, correctly aligns the spine, head, and neck, requires no break-in period, and yet allows a user to adjust the firmness of the support.

SUMMARY OF THE INVENTION

The present invention is a head and neck support device that addresses the above mentioned problems through the use of several integrated components with different but fixed degrees of firmness, and at least one component with an adjustable degree of firmness. In combination, these components provide user adjustable support for the head and neck region, correctly align the spine, head, and neck of a user for comfortable, therapeutic benefits, and do not require the user to endure a break-in period to allow the device to conform to the shape of the user's head.

An embodiment of the present invention comprises a firm core, a recess located on a top surface of the firm core, a layer of viscoelastic foam located within the recess, a C-shaped layer of viscoelastic foam covering first and second lengthwise edges and a bottom surface of the core, and one or more inflatable bladders disposed within the firm core.

DETAILED DESCRIPTION OF THE DRAWINGS

Figure 1A:
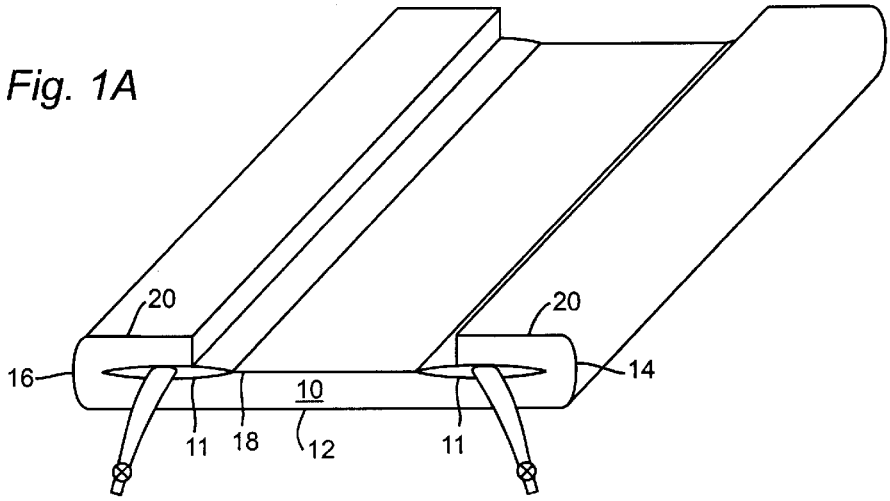
FIG. 1A is a perspective diagram of the firm core of the present invention.

Turning to FIG. 1A, a firm core 10 section of a preferred embodiment of the support device 60 of the present invention is shown. The firm core 10 is formed from a foam material, such as a polyurethane foam, foam rubber, or any other foam known in the art to be satisfactory for this use. It is preferred that a firm, flexible polyurethane foam be used for the core 10, wherein the foam used has a higher density than the materials used in constructing the other components of the support device 60. An exemplary foam for this purpose is 180/28 polyurethane foam (also known in the industry simply as 18/28 foam). Another exemplary foam is 180/33 foam.

Figure 2A:
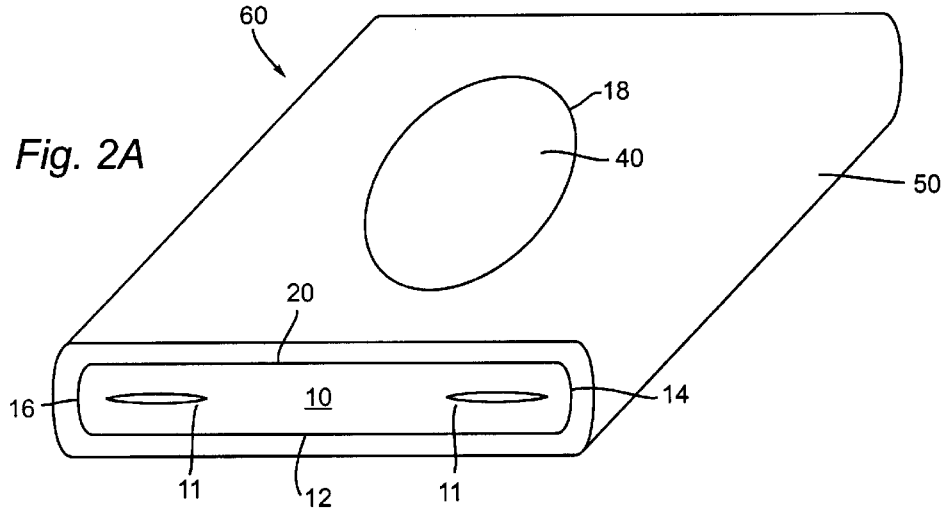
FIGS. 2A–2C are perspective illustrations of alternate embodiments of the top surface of the present invention.
Figure 2B:
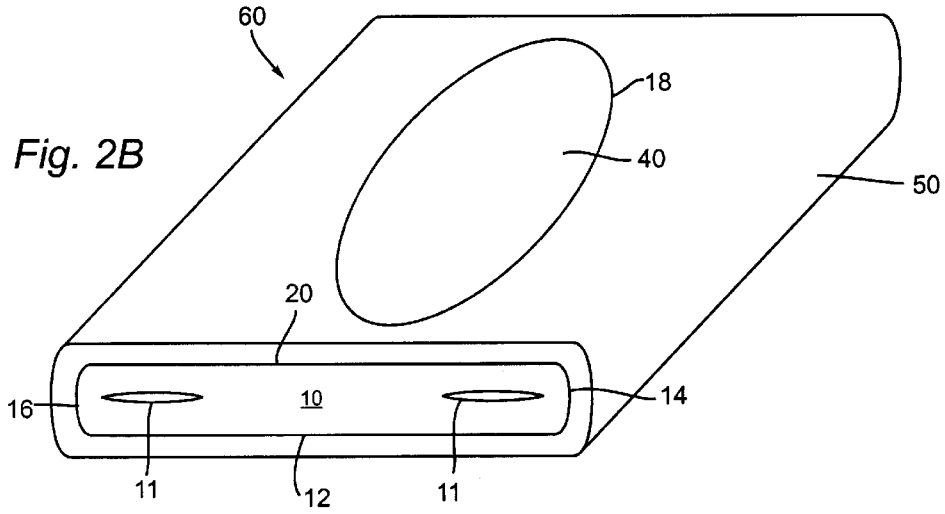
Figure 2C:
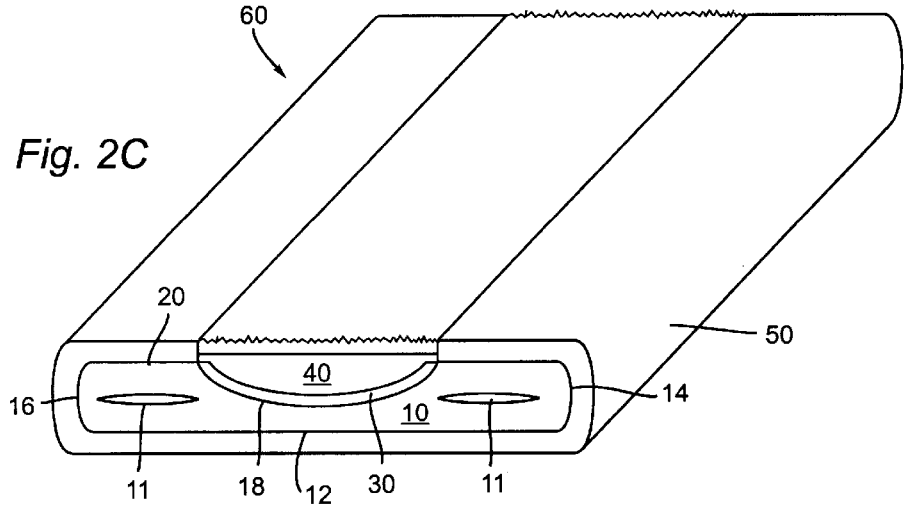

In the firm core of FIG. 1A, the core 10 has generally a rectangular shape with rounded lengthwise edges 14 and 16. A top surface 20 of the core 10 contains a recess 18 that is also generally rectangular in shape, as shown in FIG. 1A, and extends the length of the firm core 10. It is within this recess that a user will place their head when utilizing the present invention. Alternate embodiments of the recess 18 are shown in FIGS. 2A–2C, demonstrating that the recess 18 may take the form of other shapes including a concave-circular depression (FIG. 2A), a concave-elliptical depression (FIG. 2B), or a concave depression that extends the length of the support device 60 (FIG. 2C).

Returning to the firm core 10 of FIG. 1A, it is shown that recess 18 is positioned closer to lengthwise edge 16 than to lengthwise edge 14, resulting in a relatively wide lengthwise edge 14 and a relatively narrow lengthwise edge 16. This variation in the widths of the lengthwise edges 14 and 16, shown in FIG. 1A, provides users with two options as to how to orient the support device 60. Users with longer necks may find that they obtain greater support and comfort using wide lengthwise edge 14, whereas users with shorter necks may find that narrow lengthwise edge 16 is better suited for their bodies. However, this may vary with a person's individual medical condition. In an alternate embodiment, the two lengthwise edges may be made of equal widths.

The core 10 preferably has a width of eleven to fifteen inches, and the height of the core 10 is preferably one to four inches (without taking into account recess 18). Preferably, the length of core 10 is anywhere from twelve to thirty inches. Recess 18 is preferably anywhere from half an inch to three inches deep at its deepest point.

The firm core 10 illustrated in FIG. 1A also includes one or more inflatable bladders 11, shown in their deflated configuration. The inflatable bladders 11 can be inflated to varying degrees of firmness, thus provide variable degrees of support to the head and neck of a patient utilizing the support device 60. There are preferably two inflatable bladders 11 that are disposed within the firm core 10, extending from within the lengthwise edges 14 and 16 into the interior of the core 10. It is preferred that the bladders 11 extend into the recess 18, as shown in FIG. 1A. These bladders 11 are preferably between two to ten inches in width when deflated, and extend anywhere from a portion of the length to the entire length of the support device 60.

Figure 1B:
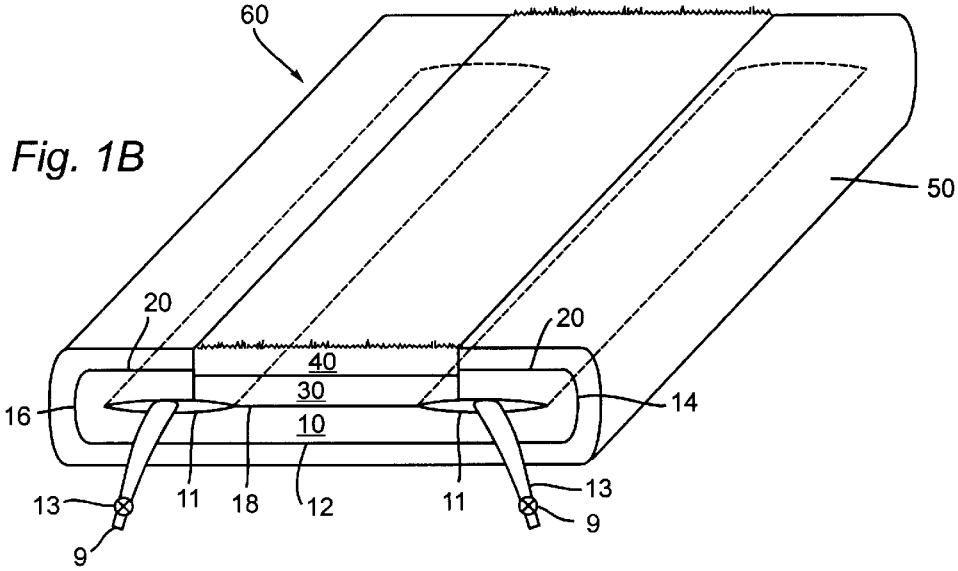
FIG. 1B is a perspective diagram of a preferred embodiment of the support device of the present invention.

Turning now to FIG. 1B, a preferred embodiment of the support device 60 of the present invention is shown. As illustrated in FIG. 1B, the support device 60 includes the firm core 10 described above and in FIG. 1A. In addition, a memory foam layer 30 is disposed within the recess 18. Memory foam layer 30 is preferably anywhere from one-quarter of an inch to two inches in thickness, and comprises a foam that is softer and less firm than the foam used for core 10. It is preferred that memory foam layer 30 comprise a material such as viscoelastic memory foam. Three, four, or five pound viscoelastic memory foams are exemplary foams for this use. In alternate embodiments, memory foam layer 30 may comprise other memory foams known in the art.

Memory foam layer 30 tends to provide a comfortable transition between the firm core 10 and a user's head. In addition, the composition and compression characteristics of viscoelastic memory foam allow it to almost instantly conform to the shape of a user's head, thus enabling the support device 60 to provide immediate comfort without the need for a break-in period. Furthermore, the placement of the memory foam layer 30 atop the dense polyurethane foam of the firm core 10 tends to overcome the problem of viscoelastic foams being too soft to provide adequate support for users.

As shown in FIG. 1B, the present invention further includes a cushion layer 40 that is disposed atop the memory foam layer 30. It is preferred that the thickness of the cushion layer 40 be between one-quarter of an inch to two inches. The cushion layer 40 tends to provide a soft compressible surface against which a user's head will rest while utilizing the support device 60. An exemplary material for this use is 1.1 oz. low-melt Dacron fiber. In an alternate embodiment, cushion layer 40 may comprise a polyester fiber material, a cotton fiber material, goose feathers or down, or other soft fiber, foam, or other materials known in the art that are suitable for this purpose.

The preferred embodiment illustrated in FIG. 1B also includes a C-shaped boundary layer 50 that wraps around the exposed portions of the core 10. Accordingly, the C-shaped boundary layer 50 surrounds the first lengthwise edge 14, a bottom surface 12, and the second lengthwise edge 16 of the core 10. The C-shaped boundary layer is preferably between one-quarter of an inch and two inches in thickness, and tends to provide added comfort and support for a user's neck and shoulder region. This C-shaped boundary layer 50 also enhances the multi head and neck alignment feature of the device 60.

The C-shaped boundary layer 50 preferably comprises a viscoelastic memory foam, thereby enabling the support device 60 to conform to the shape of a user's head and neck region without a substantial break-in period. Again, three, four, or five pound viscoelastic memory foam is the preferred material for use in this embodiment. In alternate embodiments, the C-shaped boundary layer 50 may comprise a low-density, soft, polyurethane foam, foam rubber, or other foams that are known in the art that would be suitable for use in this invention. In another embodiment, the C-shaped boundary layer 50 may comprise a water or gel filled component.

The C-shaped boundary layer 50 enhances a design advantage of the support device 60, which is allowing the head and neck to be placed in four different alignments in back-lying and side-lying body positions. When the lengthwise edges 14 and 16 are of unequal widths, there is a choice of four alignments in back-lying and side-lying positions. Alternately, when the lengthwise edges 14 and 16 are of equal widths, there is a choice of two alignments in back-lying and side-lying positions.

Figure 1C:
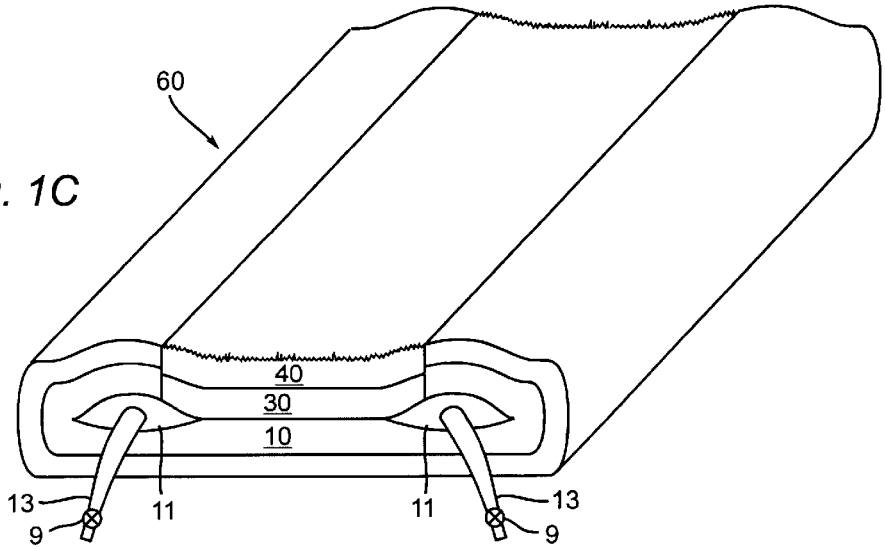
FIG. 1C is a perspective diagram of the support device of the present invention wherein a pair of inflatable bladders are inflated.

The support device 60 is capable of imparting a user-controlled adjustable degree of lift upon the neck and base of the head of a user, which can provide the user with greater support, therapeutic benefit, and comfort. This is accomplished by having a portion of each inflatable bladder 11 within the recess 18. As shown in FIG. 1C, when inflated, the bladders 11 push up and in upon the memory foam layer 30, thereby imparting a lift upon the user's head and neck. The user can generate more lift and greater firmness by increasing the level of inflation of the bladders 11.

The inflation medium used in the inflatable bladders 11 is preferably air, but in alternate embodiments it may comprise a gas or liquid, including water. Additionally, if a liquid such as water is used as the inflation medium, the temperature of the liquid may be adjusted to provide either warmth or coolness to the head and neck region of the patient. The inflation medium is introduced into and removed from the inflatable bladders 11 through valves 9 disposed within conduits 13 that extend off of each of the bladders 11.

Figure 3A:
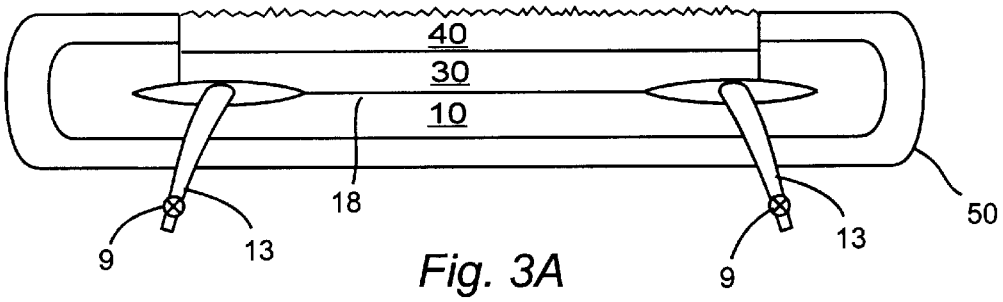
FIGS. 3A–3C are perspective illustrations of alternate embodiments of the inflatable bladders.
Figure 3B:
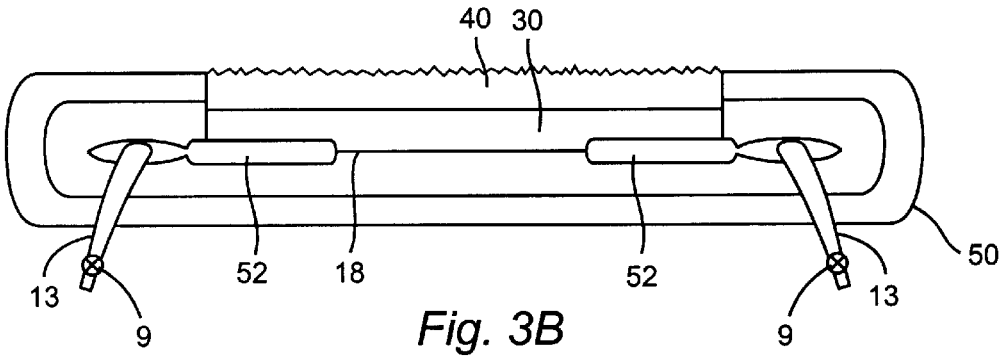
Figure 3C:
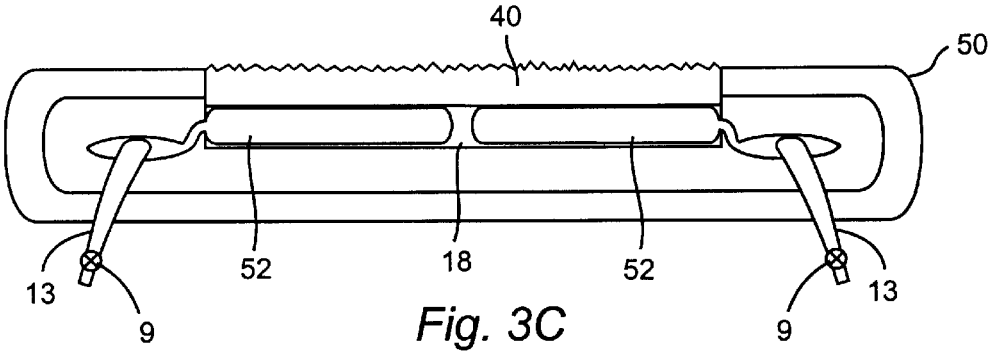

There are many alternate embodiments for the inflatable bladders 11. As shown in FIG. 3A, in one alternate embodiment of the present invention, the inflatable bladders 11 do not substantially extend into the lengthwise edges 14 and 16 and remain within the interior of the core 10, either extending into the recess 18 or simply coming close to the border of the recess 18. In another embodiment, shown in FIG. 3B, the inflatable bladders 11 each have tongues 52 that extend into the recess 18 and are located either underneath or on top of the memory foam layer 30. In FIG. 3B, the tongues are shown underneath memory foam layer 30. In this embodiment, inflation of the bladders 11 tends to provide a greater lift to the neck and base of the head of a user than the embodiment of FIG. 3A. And in yet another embodiment, shown in FIG. 3C, the tongues 52 of the inflatable bladders 11 are used to entirely replace the memory foam layer 30.

Figure 4:
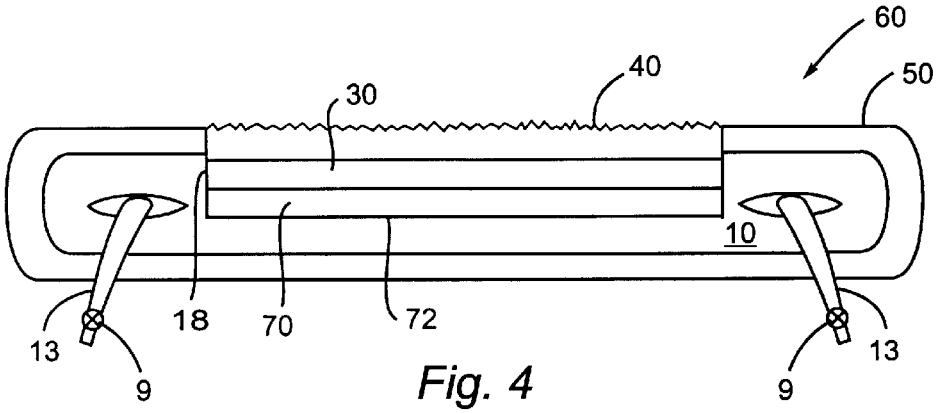
FIG. 4 is a cross-sectional diagram of an alternate embodiment of the present invention.

Turning now to FIG. 4, an alternate embodiment of the present invention is shown wherein a rigid support layer 70 is disposed on the bottom surface 72 of the recess 18, sandwiched between the core 10 and the memory foam layer 30. This rigid support layer 70 tends to provide added support for users that require a firmer support device 60. The rigid support layer 70 preferably comprises a high density polyurethane foam that is higher in density than core 10. Exemplary foams for this use is 180/33 or 180/36 polyurethane foam (also known as 18/33 and 18/36 foam). In alternate embodiments, extra support layer 70 may comprise a dense foam rubber, a dense viscoelastic foam, polystyrene, polypropylene, or any other dense foam or rigid material known in the art that may be suitable for use with the present invention.

Thus, an orthopedic head and neck support device utilizing a number of components with different amounts of firmness and one component with an adjustable amount of firmness has been described for providing versatile support to the head and neck of a user. The spine, head, and neck of a user are aligned with the basic design construction features of the support device plus user-adjustable support, and the device has no break-in period. While embodiments, applications, and advantages of the invention have been shown and described, many more embodiments, applications, and advantages are possible without deviating from the inventive concepts described herein. The invention, therefore, is not to be restricted except in accordance with the spirit of the appended claims.

What is claimed:

1. A support device, comprising:

a core comprising a first and a second edge, a top surface, and a bottom surface;

a recess formed in said first surface of said core;

a first foam layer disposed within said recess;

a C-shaped boundary layer covering said first edge of said core, said second surface of said core, and said second edge of said core; and an inflatable bladder disposed within the core.

2. The support device of claim 1, further comprising a cushion layer disposed on a surface of said first foam layer.

3. The support device of claim 1, wherein the recess extends from a first widthwise edge of the core to a second widthwise edge of the core.

4. The support device of claim 3, wherein the recess is located closer in proximity to the first edge than to the second edge.

5. The support device of claim 1, wherein the recess is concave.

6. The support device of claim 5, wherein the recess is also circular.

7. The support device of claim 5, wherein the recess is also elliptical.

8. The support device of claim 1, wherein the first and second edges are rounded.

9. The support device of claim 1, wherein the core is formed from a high density polyurethane foam.

10. The support device of claim 1, wherein the recess is formed by removing a rectangular prism shaped section out of the top surface of the core.

11. The support device of claim 1, wherein the foam layer is formed from a viscoelastic memory foam.

12. The support device of claim 2, wherein the cushion layer is formed from a soft fiber.

13. The support device of claim 1, wherein the C-shaped boundary layer is formed from a viscoelastic memory foam.

14. The support device of claim 1, further comprising a second foam layer disposed within the recess between the core and the first foam layer.

15. The support device of claim 14, wherein the second foam layer comprises a high density polyethylene foam, wherein the density of the second foam layer is higher than the density of the core.

16. The support device of claim 1, wherein the inflatable bladder utilizes water as an inflation medium.

17. The support device of claim 1, wherein the inflatable bladder utilizes air as an inflation medium.

* * * * *